US009102449B2

(12) United States Patent
Gatton et al.

(10) Patent No.: US 9,102,449 B2
(45) Date of Patent: Aug. 11, 2015

(54) DISPENSING CAP

(71) Applicant: The Packaging Design Group, Hunt Valley, MD (US)

(72) Inventors: Brian Gatton, Franklinville, NJ (US); Kenneth Gillman, Lutherville, MD (US)

(73) Assignee: THE PACKAGING DESIGN GROUP, Hunt Valley, MD (US)

( * ) Notice: Subject to any disclaimer, the term of this patent is extended or adjusted under 35 U.S.C. 154(b) by 86 days.

(21) Appl. No.: 14/075,197

(22) Filed: Nov. 8, 2013

(65) Prior Publication Data

US 2015/0129531 A1 May 14, 2015

(51) Int. Cl.
*B65D 50/04* (2006.01)
*B65D 83/06* (2006.01)

(52) U.S. Cl.
CPC ..... *B65D 50/041* (2013.01); *B65D 83/06* (2013.01)

(58) Field of Classification Search
CPC .. B65D 41/32; B65D 41/3457; B65D 50/041; B65D 50/06–50/062; B65D 2215/00; B65D 2215/02; B65D 2215/04; B65D 2251/105
USPC ..... 220/254.3, 254.5, 254.7–254.9, 255, 220/257.2, 259.1–259.4, 315, 319–320; 215/201, 217–220, 221, 224–225, 230, 215/274–275
See application file for complete search history.

(56) References Cited

U.S. PATENT DOCUMENTS

| | | | | |
|---|---|---|---|---|
| 3,469,725 | A * | 9/1969 | Turner | 215/225 |
| 3,584,760 | A * | 6/1971 | Grinker | 220/375 |
| 3,811,589 | A * | 5/1974 | Thornton et al. | 215/225 |
| 4,385,706 | A * | 5/1983 | Freeman | 215/225 |
| 4,941,580 | A * | 7/1990 | Julian | 215/235 |
| 6,923,335 | B2 * | 8/2005 | Fujita et al. | 220/291 |
| 7,222,754 | B2 * | 5/2007 | Ho | 222/153.1 |
| 2004/0206779 | A1 * | 10/2004 | Foster et al. | 222/153.09 |
| 2005/0205607 | A1 * | 9/2005 | Hierzer et al. | 222/153.1 |
| 2007/0144996 | A1 * | 6/2007 | Sawyer | 215/235 |
| 2010/0147732 | A1 * | 6/2010 | Delagrange et al. | 206/528 |
| 2011/0094990 | A1 * | 4/2011 | Sprishen et al. | 215/217 |
| 2012/0267336 | A1 * | 10/2012 | Faragher et al. | 215/224 |
| 2013/0043206 | A1 * | 2/2013 | Ochoa Laburu | 215/237 |

* cited by examiner

*Primary Examiner* — Bryon Gehman
*Assistant Examiner* — Brijesh V. Patel
(74) *Attorney, Agent, or Firm* — Heslin Rothenberg Farley & Mesiti P.C.; Brett M. Hutton

(57) ABSTRACT

A dispensing cap including a closure having a top pivotably mounted to a base by a hinge. The closure is rotatably mounted to a ring. The top of the dispensing cap is opened only when the hinge is aligned with a notch formed in the ring and pressure is applied to flexible areas of the ring to disengage mating members of the ring and the top.

12 Claims, 6 Drawing Sheets

DISPENSING CAP

BACKGROUND OF THE INVENTION

The invention relates to container caps and, more particularly a cap for use on, for example, a container capable of dispensing, but not limited to, liquids, powders and solids including, for example, capsules, caplets, tablets, and gel caps.

Safety or child resistant caps are used to reduce the risk of children accessing and ingesting dangerous or toxic items. Prior attempts at designing and engineering a safety or child resistant cap for dispensing items are either insufficiently childproof or too difficult for an older adult to open. For example, existing child resistant closures require a simultaneous push and turn manipulation with one hand holding the container and the other hand pushing down on the closure while turning the closure in the unscrewing direction. Another example requires holding the container in one hand and with the other hand squeezing the skirt from the opposite sides and simultaneously unscrewing the closure from the container. These prior attempts do not, however, provide an adequate child resistant design to a flip top closure. Generally, the common flip top dispensing caps used for tablets, such as vitamins and drugs, use a screw on non-child resistant cap. However, those type of caps can only be used on products that do not require a child resistant feature. There is, therefore, a need for an efficiently designed child resistant flip top dispensing closure.

SUMMARY OF THE INVENTION

The shortcomings of the prior art are overcome and additional advantages are provided through use of a dispensing cap constructed in accordance with one or more principles of the present invention. The dispensing cap constructed in accordance with one or more aspects of the present invention may be used with any type of dispensing container containing, for example, but not limited to, liquids, powders and solids including, for example, capsules, caplets, tablets, and gel caps. Additionally, other uses may be made of the invention that fall within the scope of the claimed invention but when are not specifically described below.

In one aspect of the invention, there is provided a dispensing cap comprising a closure and a ring. The closure includes a base including an annular base side wall and a top surface including a dispensing orifice. The closure also includes a top pivotably mounted to the base for pivoting the top between an open position and a closed position over the dispensing orifice of a top surface of the base, The top may include at least one projection extending outwardly and/or the base may include a thumb depression to assist a user flip open the top. The ring is rotabably mounted to the base of the closure. The ring includes a ring side wall comprising a first set of opposite wall sections and a second set of opposite wall sections. The first set of opposite wall sections each includes a respective notch. The second set of opposite wall sections comprises a flexible area and an inner wall including at least one projection extending inwardly.

In another aspect of the invention, the at least one projection extending outwardly from the top engages the at least one projection extending inwardly from the inner wall of the second set of opposite wall sections when the hinge is aligned with one of the notches to prevent the top from pivotably opening from the closed position. In another aspect of the invention, the top of the closure is further prevented from pivotably opening from the closed position when the hinge is not aligned with the first set of opposite wall sections. The top of the closure is pivotably opened from the closed position when the hinge is aligned with one of the notches in the first set of opposite wall sections and when compression is applied to the flexible area to disengage the at least one projection extending outwardly from the top from the at least one projection extending inwardly from the inner wall of the second set of opposite wall sections.

Additional features and advantages are realized through the techniques of the present invention. Other embodiments and aspects of the invention are described in detail herein and are considered a part of the claimed invention.

BRIEF DESCRIPTION OF THE SEVERAL VIEWS OF THE DRAWINGS

One or more aspects of the present invention are particularly pointed out and distinctly claimed as examples in the claims at the conclusion of the specification. The foregoing and objects, features, and advantages of one or more aspects of the invention are apparent from the following detailed description taken in conjunction with the accompanying drawings in which:

DETAILED DESCRIPTION

Figure 1:
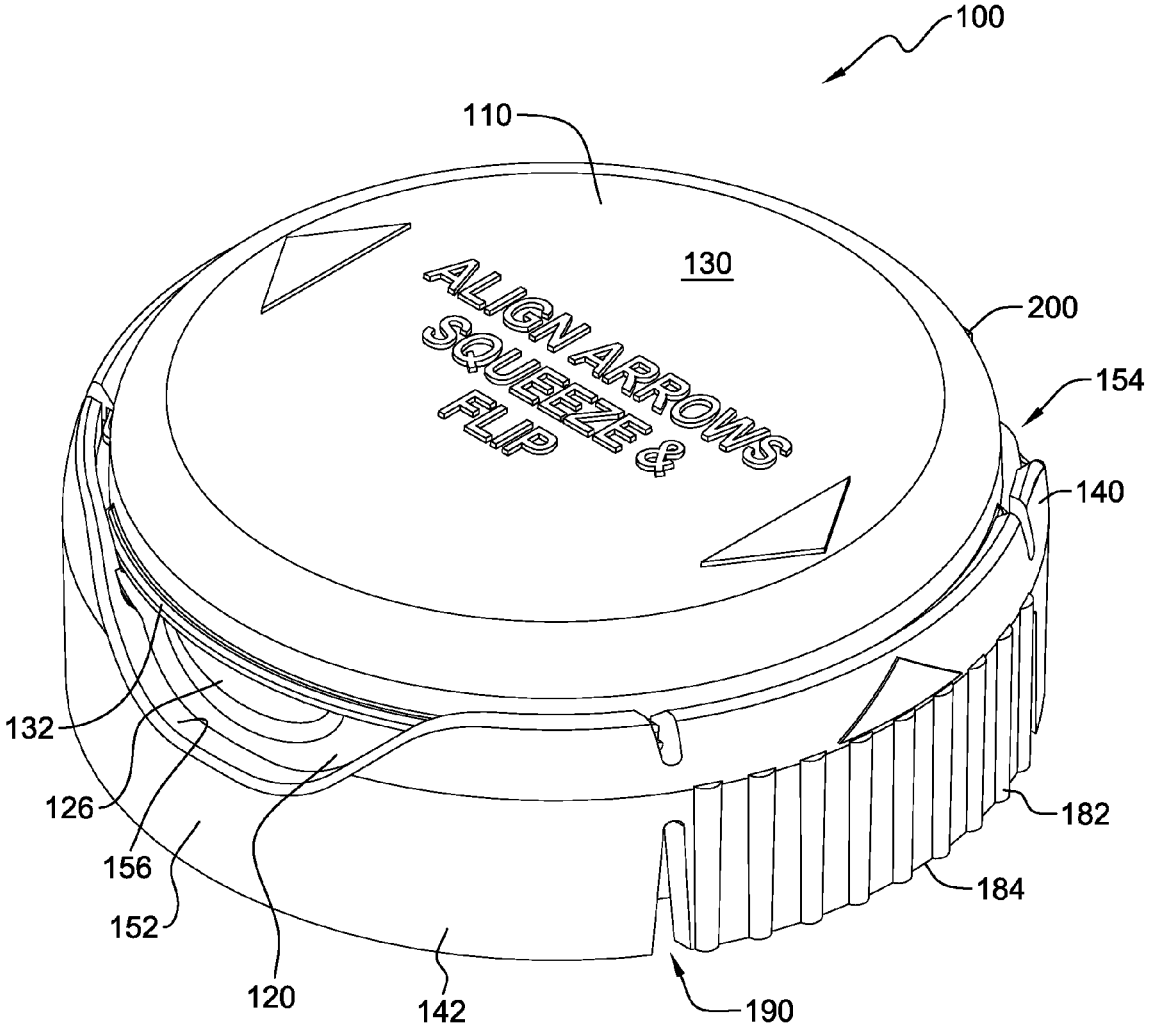
FIG. 1 depicts a perspective view of an embodiment of a dispensing cap constructed in accordance with one or more aspects of the present invention illustrating a thumb depression and/or flange in alignment with a notch formed in a ring.

For the purposes of promoting an understanding of the principles of a closure designed and constructed in accordance with one or more aspects of the present invention, reference will now be made to the embodiments, or examples, illustrated in the drawings and specific language will be used to describe these. It will nevertheless be understood that no limitation of the scope of the invention is thereby intended. Any alterations and further modifications in the described embodiments, and any further applications of the principles of the invention as described herein are contemplated as would normally occur to one skilled in the art to which the check valve invention relates.

Presented herein is a dispensing cap comprising, in one embodiment, multiple features that may be attached to or integrated into the cap to, for example, prevent access to a child. Generally, in one aspect, the dispensing cap that involve a closure surrounded by ring that require specific alignment and engagement by two hands. For example, opening of the cap requires orientation and alignment of a ring in relation to a hinge and/or opening flange of a top of the cap, as well as, application of pressure to the sides of the ring to disengage the ring from the top. A dispensing cap constructed in accordance with one or more aspects of the present invention may be mounted on to a container capable of dispensing, for example, liquids, powders and solids including, for example, capsules, caplets, tablets, and gel caps. To ensure that a child cannot simply unscrew the cap, the dispensing cap may be, for example, press or snap fit onto the container or affixed or attached by other suitable means to prevent the removal of the cap from the container.

Figure 2:
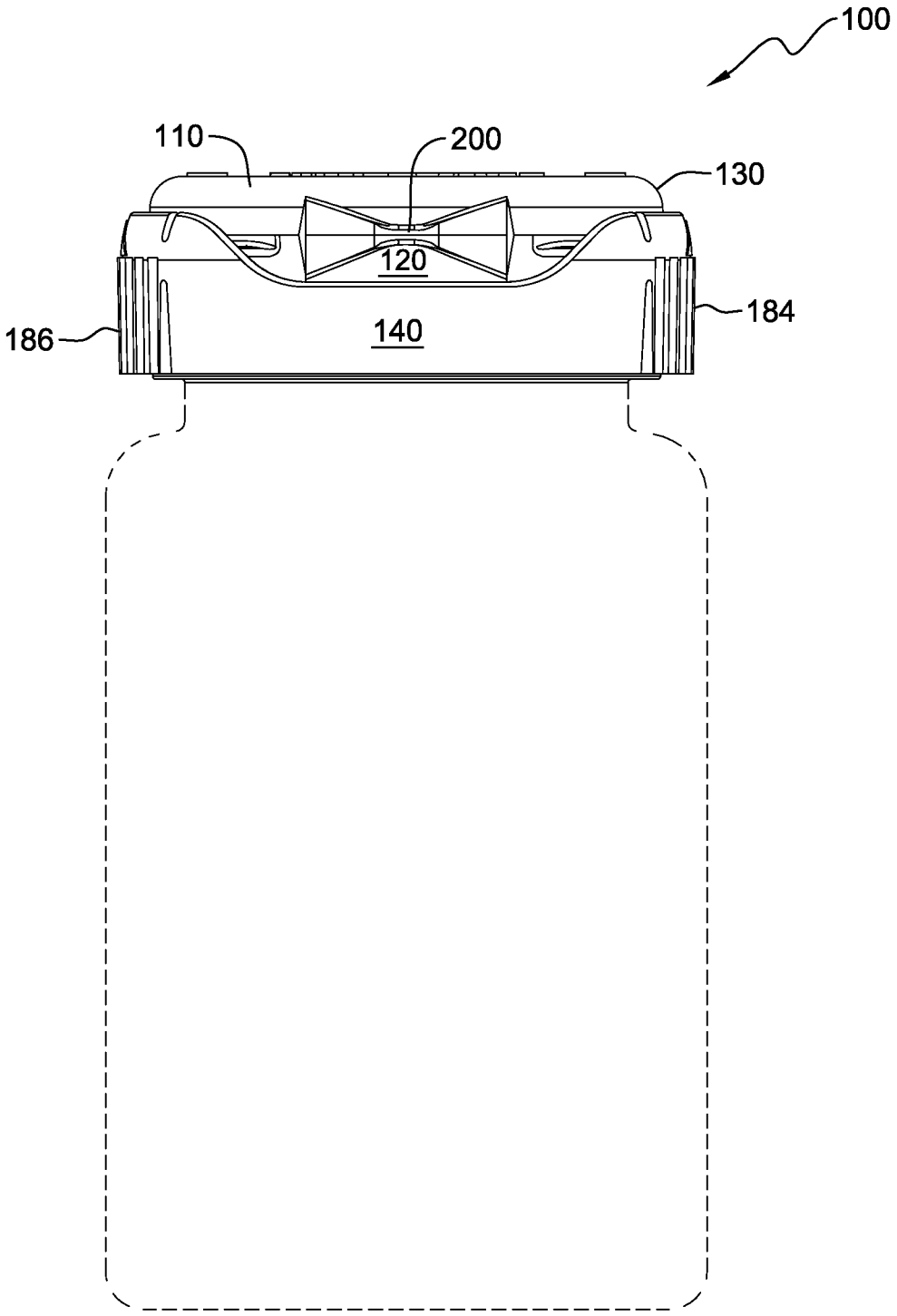
FIG. 2 depicts a back view of an embodiment of a dispensing cap constructed in accordance with one or more aspects of the present invention illustrating a hinge connecting the top and base of a closure in alignment with a notch formed in a ring surrounding part of the side of the closure.

By way of example, FIGS. 1 and 2 depict a dispensing cap constructed in accordance with one or more aspects of the present invention. Dispensing cap 100 depicted in FIG. 1 includes a closure 110 and a ring 140 surrounding and rotatable mounted to closure 110. Closure 110 includes a base 120 and a top 130. Top 130 is pivotably mounted to base 120 by, for example, a hinge 200.

Figure 3:
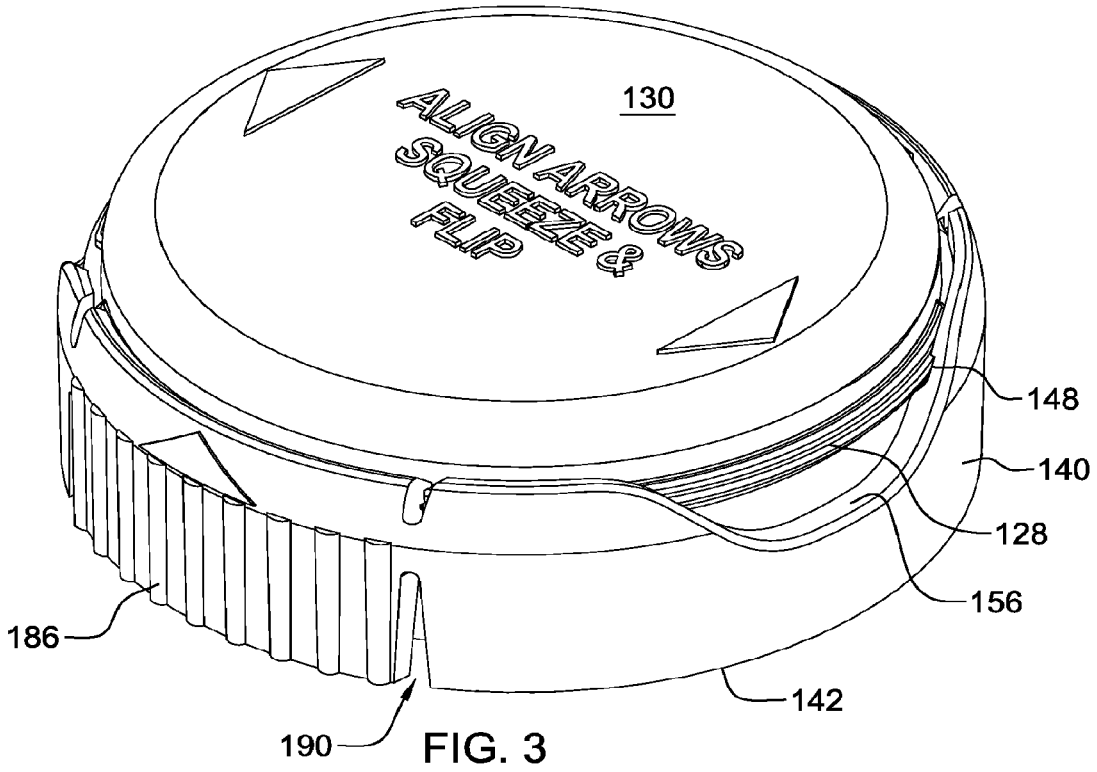
FIG. 3 depicts a perspective view of an embodiment of a dispensing cap constructed in accordance with one or more aspects of the present invention in a locked position.
Figure 4:
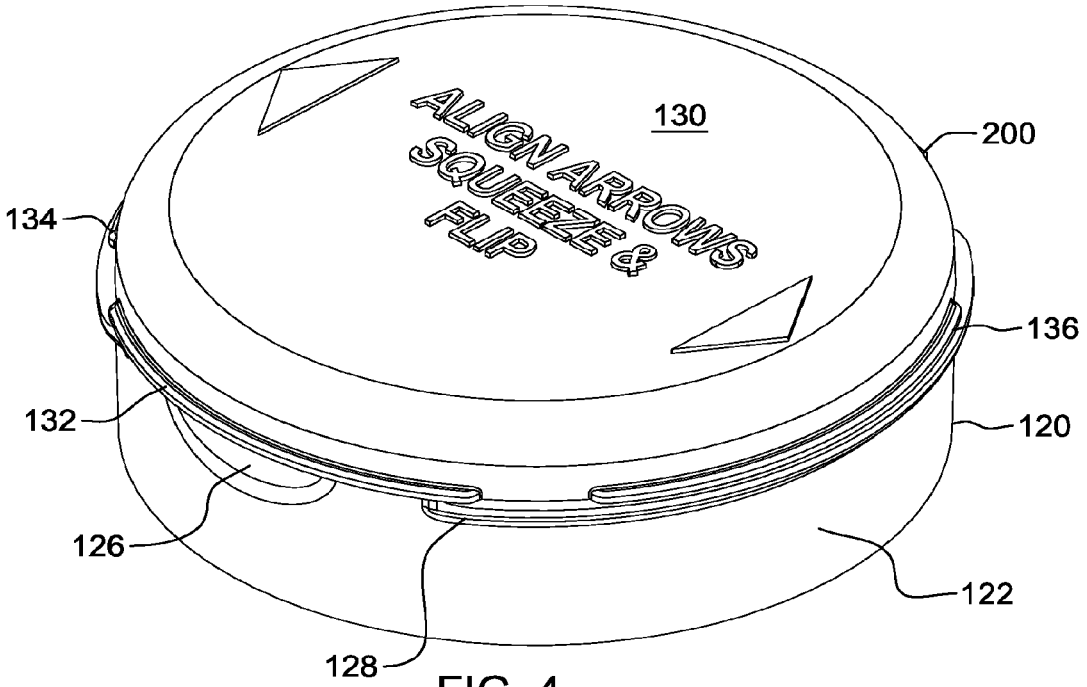
FIG. 4 depicts a perspective view of an embodiment of a closure of a dispensing cap constructed in accordance with one or more aspects of the present invention.
Figure 6:
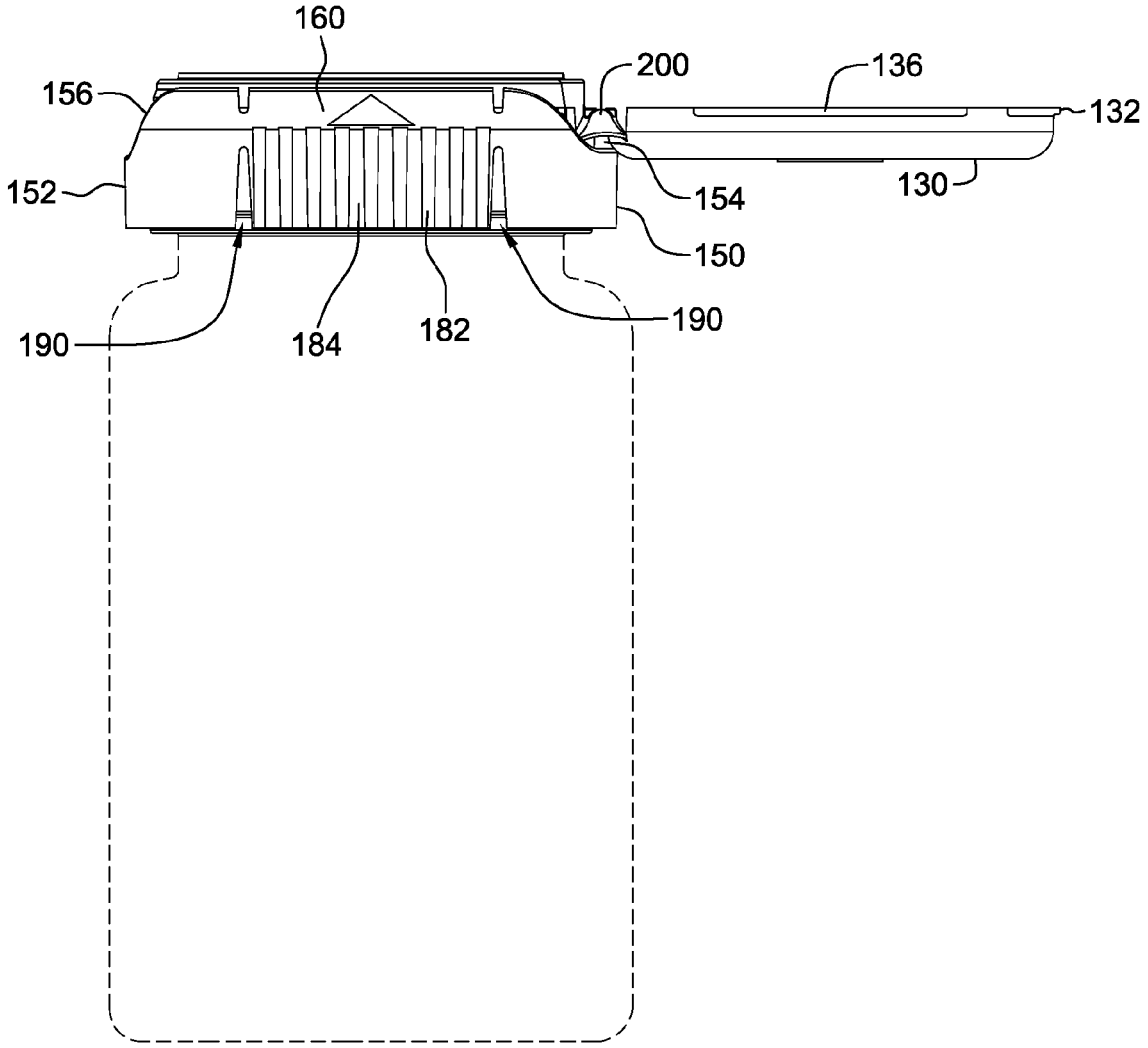
FIG. 6 depicts a side view of an embodiment of a dispensing cap constructed in accordance with one or more aspects of the present invention in a fully opened position.
Figure 7:
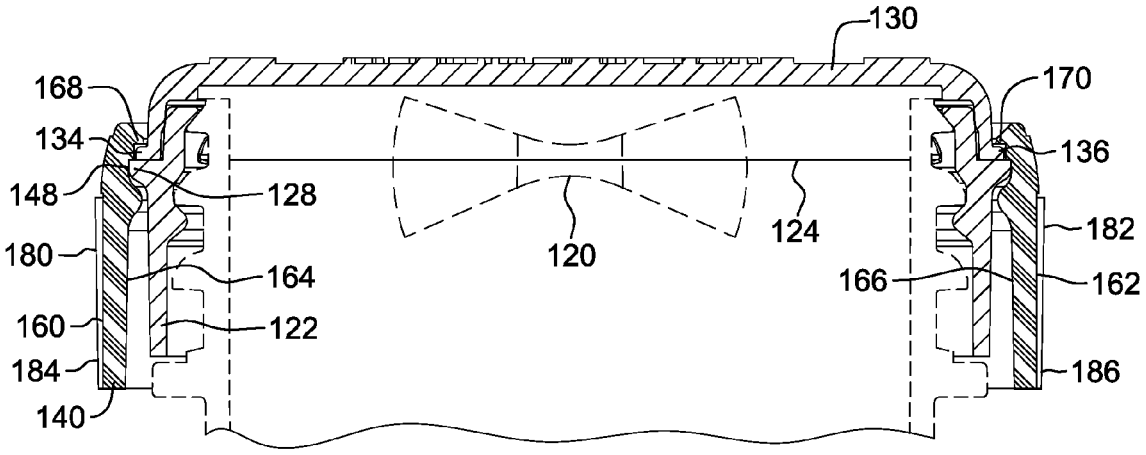
FIG. 7 depicts a vertical sectional view of a dispensing cap constructed in accordance with one or more aspects of the present invention illustrating the engagement of a top and a ring when the sides of the ring are not compressed.

FIGS. 1-5 depict one example of base 120 and top 130. As shown in FIG. 4, base 120 includes an annular side wall 122 and a dispensing orifice 124 (as illustrated in FIGS. 6 and 7) defined by, in one example, annular side wall 122. In an alternative embodiment, dispensing orifice 124 may be smaller and formed in, for example, a deck or top surface extending from a top edge of base side wall 122. For purposes of this invention, the size and shape of dispensing orifice is not critical. When the cap is closed, top 130 covers dispensing orifice 124.

Top 130 includes flange 132 projecting outwardly from an edge or region of top 130 opposite the edge or region where hinge 200 connects top 130 to base 120. Flange 132 may be used to assist in opening and closing cap 100. Base 120 may also include a thumb recession 126 that is, for example, formed in side wall 122 to assist in opening cap 100. Cap 100 may use both flange 132 and thumb recession 126 or only one of these features to assist a user in pivotably opening top 130 from base 120.

Figure 5:
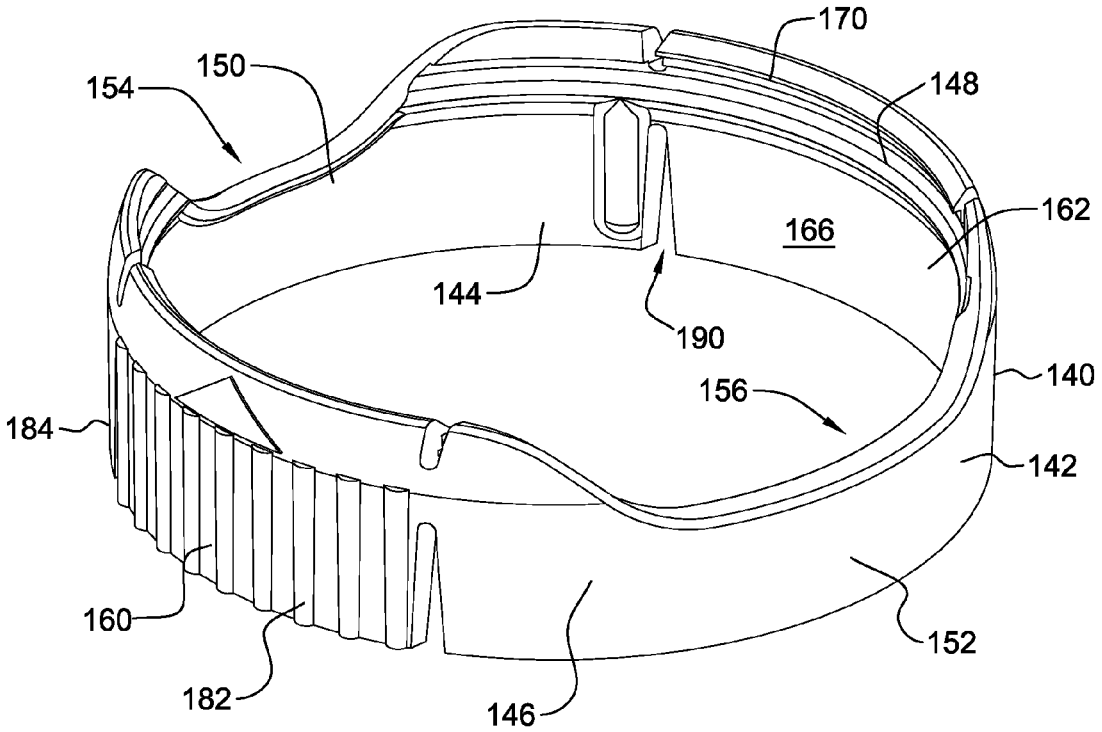
FIG. 5 depicts a perspective view of one embodiment of a ring of a dispensing cap constructed in accordance with one or more aspects of the present invention.

FIG. 5 illustrates one embodiment of ring 140. Ring 140 depicted in FIG. 5 includes a side wall 142 that surrounds at least a part of side wall 122 of base 120 and top 130. Side wall 142 includes an inner side 144 and an outer side 146. Inner side 144 faces side wall 122 of base 120. Inner side 144 includes channels 148 that are adapted to receive mating ridges 128 projecting outwardly from the outer surface of side wall 122 of base 120. The mating relationship between channels 148 and ridges 128 of base 120 allow ring 140 to rotate around base 120. During construction, when ring 140 is installed over base 120, ridge 128 of base 120 could snap into place in channel 148 of ring 140. In an alternative embodiment, side wall 122 of base 120 may include the channels that mate or receive ridges projecting inwardly from inner side 144 of ring 140.

Ring 140 may be used in conjunction with closure 110 to provide numerous ways to prevent a child from opening dispensing cap 100. In one embodiment, as illustrated in FIG. 3, ring 140 may be used to, for example, prevent operation of hinge 200 and/or access to flange 132 or thumb depression 126. In this example, side wall 142 of ring 140 comprises a number of regions or wall sections. For example, as depicted in FIGS. 3 and 5, side wall 142 may include a first set of opposite wall sections 150 and 152 and a second set of opposite wall sections 160 and 162. First set of opposite wall sections 150 and 152 may each include a notch 154 and 156. When, as depicted in FIGS. 1, 2 and 6, notch 154 is aligned with hinge 200 and notch 156 is aligned with flange 132 and/or thumb depression 126, top 130 is allowed to pivotably open from base 120. In an alternative embodiment, notch 156 may align with hinge 200 and notch 154 may align with flange 132 and/or thumb depression 126. As depicted in this embodiment illustrated in FIG. 5, second set of opposite wall sections 160 and 162 are high enough to hide or prevent a user from accessing hinge 200, flange 132 of top 130 and/or thumb recession 126 of base 120 when second set of opposing wall sections are aligned with the same.

In another embodiment, as illustrated in FIGS. 1 and 7, ring 140 may be used to, for example, prevent opening of dispensing cap 100 even when hinge 200 is unhindered and/or when flange 132 and/or thumb depression 126 are accessible. In this embodiment, second set of opposite wall sections 160 and 162 each includes an inner walls 164 and 166, respectively and an outer walls 180 and 182, respectively. Inner walls 164 and 166 may each include ridges 168 and 170, respectively, protruding inwardly that engages flanges 134 and 136 projecting outwardly from top 130 when, for example, hinge 200 and flange 132 of top 130 and/or thumb depression 126 of base 120 are aligned with notches 154 and 156 of ring 140. In one embodiment, ridges 168 and 170 and/or flanges 134 and 136 may be formed as opposing hooks to prevent top 130 from opening from base 120 from a closed position. Ridges 168 and 170 on inner walls 164 and 166, respectively, may also engage flange 132 of top 130, as illustrated in FIG. 3, to prevent opening of top 130 from base 120 when flange 132 is not in alignment with either of the notches 154 and 156.

Outer walls 180 and 182 include a flexible areas 184 and 186, respectively. Flexible area 184 and 186 are partially severed between a pair of vertical cuts 190 extending upwardly from the bottom of ring 140, as depicted in FIG. 5. Inward compression or pressure applied to or against flexible areas 184 and 186 will deflect or disengage ridges 168 and 170 of inner walls 164 and 166, respectively, from flanges 134 and 136 of top 130. For example, as compression or pressure is applied to flexible areas 184 and 186, flexible areas 184 and 186 deflect inwardly towards side wall 122 of base 120 while ridges 168 and 170 of inner walls 164 and 166, respectively, deflect outwardly away from outer wall 122 of base 120 and flanges 134 and 136 of top 130 on either side of a pivot. In one embodiment, this pivot may be the location where channels 148 of ring 140 mate with ridges 128 of base 120. Once ridges 168 and 170 are disengaged or deflected from flanges 134 and 136, top 130 may be permitted to open from base 120.

Dispensing cap 100 may be childproof because opening of top 130 from base 120 requires, for example, alignment of notches 154 and 156 with hinge 200 and flange 132 of top 130 and/or thumb depression 126 of base 120, or in alternative embodiments another engageable part of either top 130 or base 120 that assists a user to flip open top 120 from a closed position, and application of enough pressure against flexible areas 184 and 186 between the pair of vertical cuts to disengage ridges 168 and 170 of inner walls 164 and 166, respectively, from flanges 134 and 136 of top 130. In order to open the embodiment depicted in, for example, FIG. 3, a user rotates ring 140 around base 120 until notches 154 and 156 align with hinge 200 and flange 132 of top 130, as illustrated in FIG. 1. A user must then apply pressure with one hand to flexible areas 184 and 186 to disengage ridges 168 and 170 of inner walls 164 and 166, respectively, from flanges 134 and 136 of top 130. While applying pressure to flexible areas 184 and 186, the user must use the other hand to flip open top 130 from base 120 using flange 132 of top 130 or thumb depression 126 of base 120.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A dispensing cap, said dispensing cap comprising:

a closure, said closure comprising a base and a top, the base including an annular base side wall and a dispensing orifice, the top mounted to the base by a hinge for pivoting the top between an open position and a closed position over the dispensing orifice of the base; and a ring rotatably mounted to the base of said closure, said ring including a ring side wall surrounding at least a part of the annular base side wall of the base, the ring side wall comprising a first set of opposite wall sections and a second set of opposite wall sections, wherein the first set of opposite wall sections includes a notch, wherein the top of said closure is pivotably opened from the closed position when the hinge is aligned with the notch in the first set of opposite wall sections, and wherein the top of said closure is prevented from pivotably opening from the closed position when the hinge is aligned with the second set of opposite wall sections, and wherein at least one projection extending outwardly from the top engages at least one projection extending inwardly from the inner wall of the second set of opposite wall sections when the hinge is aligned with the notch of the first set of opposite wall sections to further prevent the top from pivotably opening from the closed position, wherein the second set of opposite wall sections of the ring side wall further includes a flexible area, wherein compression of the flexible area disengages the at least one projection extending outwardly from the top from the at least one projection extending inwardly from the inner wall of the second set of opposite wall sections when the hinge is aligned with the notch of the first set of opposite wall sections to allow the top to pivotably open from the closed position.

2. The dispensing cap of claim 1, wherein the top includes a flange projecting outwardly from a region of the top opposite the hinge, wherein the first set of opposite wall sections each includes a respective notch, wherein the flange is aligned with one of the respective notches in the first set of opposing wall sections of the ring side wall and the hinge is aligned with the other of the respective notches in the first set of opposing wall sections during opening of the top from the closed position.

3. The dispensing cap of claim 2, wherein the flange of the top engages a ridge extending inwardly from an inner wall of the second set of opposite wall sections of the ring side wall when the flange is aligned with the second set of opposite wall sections to prevent the top of said closure from pivotably opening from the closed position.

4. The dispensing cap of claim 1, wherein the first set of opposite wall sections each includes a respective notch, wherein the annular base side wall of the base of said closure includes a thumb depression, the thumb depression being aligned with one of the respective notches in the first set of opposing wall sections of the ring side wall opposite the notch aligned with the hinge during opening from the closed position.

5. The dispensing cap of claim 1, wherein the dispensing cap is snap fit to a container.

6. The dispensing cap of claim 1, wherein the dispensing cap is screwed onto a container.

7. The dispensing cap of claim 1, wherein the dispensing cap is affixed to a container.

8. A dispensing cap, said dispensing cap comprising:

a closure, said closure comprising a base and a top, the base including an annular base side wall and a dispensing orifice, the top pivotably mounted to the base for pivoting the top between an open position and a closed position over the dispensing orifice of the base, wherein said closure includes an engageable portion for pivotably opening the top from the closed position; and a ring rotatable mounted to the base of said closure, said ring including a ring side wall surrounding at least a part of the annular base side wall, the ring side wall comprising a first set of opposite wall sections and a second set of opposite wall sections, wherein the first set of opposing wall sections includes a notch, wherein the top of said closure is pivotably opened from the closed position when the engageable portion of said closure is aligned with the notch of the first set of opposite wall sections, and wherein the top of said closure is prevented from pivotably opening from the closed position when the engageable portion is aligned with the second set of opposite wall sections, and wherein at least one projection extending outwardly from the top engages at least one projection extending inwardly from an inner wall of the second set of opposite wall sections when the engageable portion is aligned with one of the notches to further prevent the top from pivotably opening from the closed position, wherein the second set of opposite wall sections of the ring side wall further includes a flexible area, wherein compression of the flexible area disengages the at least one projection extending outwardly from the top from the at least one projection extending inwardly from the inner wall of the second set of opposite wall sections when the hinge is aligned with one of the notches to allow the top to pivotably open from the closed position.

9. The dispensing cap of claim 8, wherein the top and the base are pivotably mounted by a hinge and the engagable portion of said closure is a flange projecting outwardly from the top opposite the hinge.

10. The dispensing cap of claim 9, wherein the top and the base are pivotably mounted by a hinge and the engageable portion is a thumb depression formed in the base side wall opposite the hinge.

11. A dispensing cap, said dispensing cap comprising:

a closure, said closure comprising a base and a top, the base including an annular base side wall and a top surface including a dispensing orifice, the top pivotably mounted to the base for pivoting the top between an open position and a closed position over the dispensing orifice of the top surface of the base, the top including at least one projection extending outwardly; and a ring rotatable mounted to the base of said closure, said ring including a ring side wall, the ring side wall comprising a first set of opposite wall sections and a second set of opposite wall sections, the first set of opposite wall sections each includes a respective notch, the second set of opposite wall sections comprising a flexible area and an inner wall including at least one projection extending inwardly, wherein the at least one projection extending outwardly from the top engages the at least one projection extending inwardly from the inner wall of the second set of opposite wall sections when the hinge is aligned with one of the respective notches to prevent the top from pivotably opening from the closed position, wherein the top of said closure is further prevented from pivotably opening from the closed position when the hinge is not aligned with the first set of opposite wall sections, wherein the top of said closure is pivotably opened from the closed position when the hinge is aligned with one of the respective notches in the first set of opposite wall sections and when compression is applied to the flexible area to disengage the at least one projection extending outwardly from the top from the at least one projection extending inwardly from the inner wall of the second set of opposite wall sections.

12. A dispensing cap, said dispensing cap comprising:

a closure, said closure comprising a base and a top, the base including an annular base side wall and a dispensing orifice, the top mounted to the base by a hinge for pivoting the top between an open position and a closed position over the dispensing orifice of the base; and a ring rotatably mounted to the base of said closure, said ring including a ring side wall surrounding at least a part of the annular base side wall of the base, the ring side wall comprising a first set of opposite wall sections and a second set of opposite wall sections, wherein the first set of opposite wall sections includes a respective notch, wherein the second set of opposite wall sections includes a flexible area and a top portion, the top portion engaging the top of said closure in the closed position, wherein the top of said closure is pivotably opened from the closed position when the hinge is aligned with the notch in the first set of opposite wall sections and when compression is applied to the flexible area to disengage the top portions of the second set of opposite wall sections from the top of said closure, and wherein the top of said closure is prevented from pivotably opening from the closed position when the hinge is aligned with the second set of opposite wall sections or when the top portions of the second set of opposite wall sections is engaged with the top of the closure in the closed position.

* * * * *